US005946858A

United States Patent [19]

Staser

[11] Patent Number: 5,946,858

[45] Date of Patent: Sep. 7, 1999

[54] COLLAPSIBLE WINDOW LIFT MODULE WITH DIAGONAL STRUCTURAL LINK

[75] Inventor: Brian Hale Staser, Troy, Mich.

[73] Assignee: General Motors Corporation, Detroit, Mich.

[21] Appl. No.: 09/146,223

[22] Filed: Sep. 2, 1998

[51] Int. Cl.[6] ..... E05F 11/48; E05F 11/08

[52] U.S. Cl. ..... 49/352; 49/502; 49/139

[58] Field of Search ..... 49/502, 352, 139, 49/140; 296/146.1, 146.5

[56] References Cited

U.S. PATENT DOCUMENTS

| | | | |
|---|---|---|---|
| 2,501,092 | 3/1950 | Rappl | 49/349 |
| 2,555,859 | 6/1951 | Rappl et al. | 49/352 |
| 5,050,347 | 9/1991 | Brusasco | 49/502 X |
| 5,062,240 | 11/1991 | Brusasco | 49/502 X |
| 5,226,259 | 7/1993 | Yamagata et al. | 49/502 |
| 5,325,631 | 7/1994 | Lee et al. | 49/352 |
| 5,617,675 | 4/1997 | Kobrehel | 49/352 |

*Primary Examiner*—Daniel P. Stodola

*Assistant Examiner*—Gregory J. Strimba

*Attorney, Agent, or Firm*—Kathryn A. Marra

[57] ABSTRACT

A window lift module includes front and rear lift rails, each having a guide block slidably mounted thereon for attachment to a window panel. A drive cable is routed through and between the lift rails and attached to the guide blocks so that motion of the drive cable in one direction will lower the guide blocks along the lift rails and motion of the drive cable in the other direction will raise the guide blocks to raise the window panel. A drive mechanism such as a hand crank or electric motor is mounted on one of the lift rails to move the cable. A structural link has a first end pivotally connected to the front rail and a second end pivotally connected to the rear rail so that the lift rails are interconnected together as a module, but the lift rails may be moved relatively closer together as permitted by pivoting of the structural link and flexure of the drive cable to thereby establish the drive module in a folded and more compact position to enable insertion of the module through a relatively small opening in the door inner panel. The lift rails are then moved relatively further away from one another to their normal operating positions for attachment to the inner panel of the door.

2 Claims, 3 Drawing Sheets

COLLAPSIBLE WINDOW LIFT MODULE WITH DIAGONAL STRUCTURAL LINK

TECHNICAL FIELD

The invention relates to a window lift module for installation into the cavity of a vehicle door and more particularly provides a cable-operated module which folds to enable insertion of the module through a relatively small opening in the door inner panel.

BACKGROUND OF THE INVENTION

It is well known in motor vehicles to provide a vehicle door having inner and outer metal panels which define a cavity therebetween A window lift mechanism is installed into the cavity for raising and lowering the window panel. It is well known to construct the window lift mechanism as a module which can be assembled and tested prior to its installation into the vehicle door.

SUMMARY OF THE INVENTION

According to the invention, a window lift module includes front and rear lift rails, each having a guide block slidably mounted thereon for attachment to a window panel. A drive cable is routed through and between the lift rails and attached to the guide blocks so that motion of the drive cable in one direction will lower the guide blocks along the lift rails and motion of the drive cable in the other direction will raise the guide blocks to raise the window panel. A drive mechanism such as a hand crank or electric motor is mounted on one of the lift rails to move the cable. A structural link has a first end pivotally connected to the front rail and a second end pivotally connected to the rear rail so that the lift rails are interconnected together as a module, but the lift rails may be moved relatively closer together as permitted by pivoting of the structural link and flexure of the drive cable to thereby establish the drive module in a folded and more compact position to enable insertion of the module through a relatively small opening in the door inner panel. The lift rails are then moved relatively further away from one another to their normal operating positions for attachment to the inner panel of the door. The door latch is mounted on the rear lift rail, and a door handle is mounted on the front lift rail with an actuating cable operatively extending therebetween and being routed along and attached to the structural link.

DESCRIPTION OF THE PREFERRED EMBODIMENT

Figure 1:
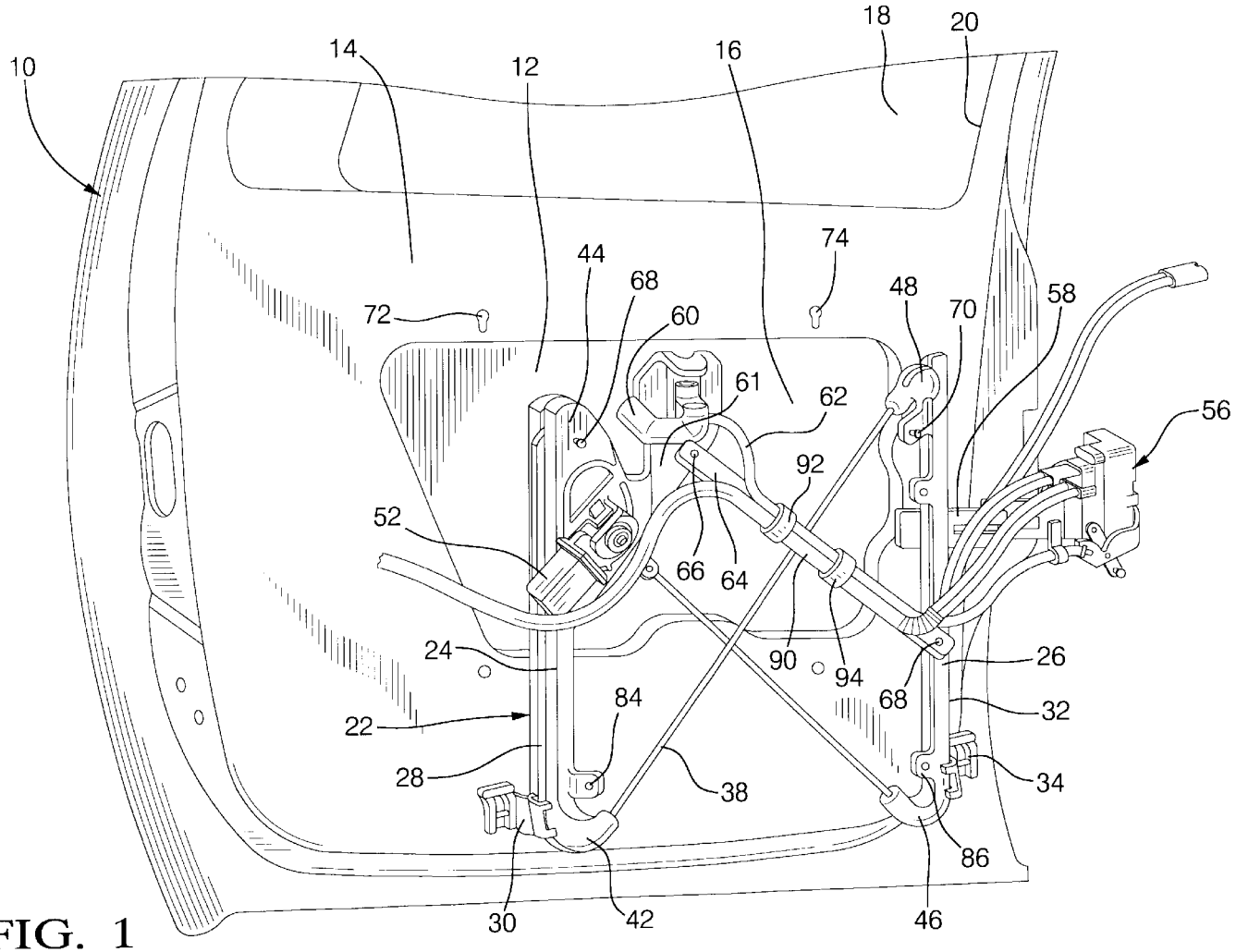
FIG. 1 is a side elevation view of a vehicle door having the window lift module shown in its fully assembled condition, awaiting installation in the vehicle door.

FIG. 1 shows a conventional vehicle door 10 comprised of an outer door panel 12 and an inner door panel 14 which are flanged together in spaced-apart relationship to define a cavity 16 therebetween. A window panel 18 is mounted within a window opening 20 of the vehicle door 10 for up and down movement between raised and lowered positions.

A window lift module generally shown at 22 is provided for raising and lowering the window panel 18. As best seen in FIG. 1, the window lift module 22 includes a front lift rail 24 and a rear lift rail 26 which extend generally vertically and are formed of metal, plastic or a combination of metal and plastic pieces, as desired. The front rail 24 includes a guide track 28 on which a guide block 30 is suitably mounted. The guide block 30 is intended for attachment to the lower edge of the window panel 18 so that raising and lowering the guide block 30 along the track 28 will raise and lower the window panel 18. The rear lift rail 26 includes guide track 32 and lift block 34. The front and rear lift rails 24 and 26 each have a tubular cavity therethrough to receive a window lift cable 38. As seen in FIG. 1, the lift cable 38 is a continuous loop of cable which is oriented in a recumbent FIG. 8 configuration. The front lift rail 24 includes a lower cable guide elbow 42 and an upper cable guide elbow 44. The rear lift rail 26 has a lower cable guide elbow 46 and an upper cable guide elbow 48 to enable the FIG. 8 configuration of the lift cable 38.

A window lift motor 52 is mounted on the front lift rail 24 and includes a pulley (not shown) which meshes with the lift cable 38. It will be understood that the motor 52 may be energized to move the cable 38 in one direction which will simultaneously raise the guide blocks 30 and 34, while reversing the motor will simultaneously lower the guide blocks 30 and 34.

A door latch assembly 56 is suitably attached to the rear lift rail 26 by a cantilevered mounting arm 58. The door latch is operated by a door handle 60 which is suitably mounted on the front lift rail 22 by bracket 61 and connected to the door latch 56 by a door latch actuating cable 62.

The parallel extending front rail 24 and rear rail 26 are interconnected by a diagonally-extending structural link 64 of stamped steel or suitable plastic construction. The forward end of the structural rail 64 is attached to the front lift rail 24 between the upper and lower end portions of the front lift rail 24 by a pivot pin 66, and the rearward end of the structural rail 64 is attached to the rear lift rail 26 between the upper and lower end portions of the rear lift rail 26 by a pivot pin 68.

FIG. 1 shows the lift rails 24 and 26 at their normal parallel spaced-apart condition in readiness for installation into the vehicle door. The window lift module 22 has been assembled at the module manufacturing plant and has been pretested for proper operation.

Figure 2:
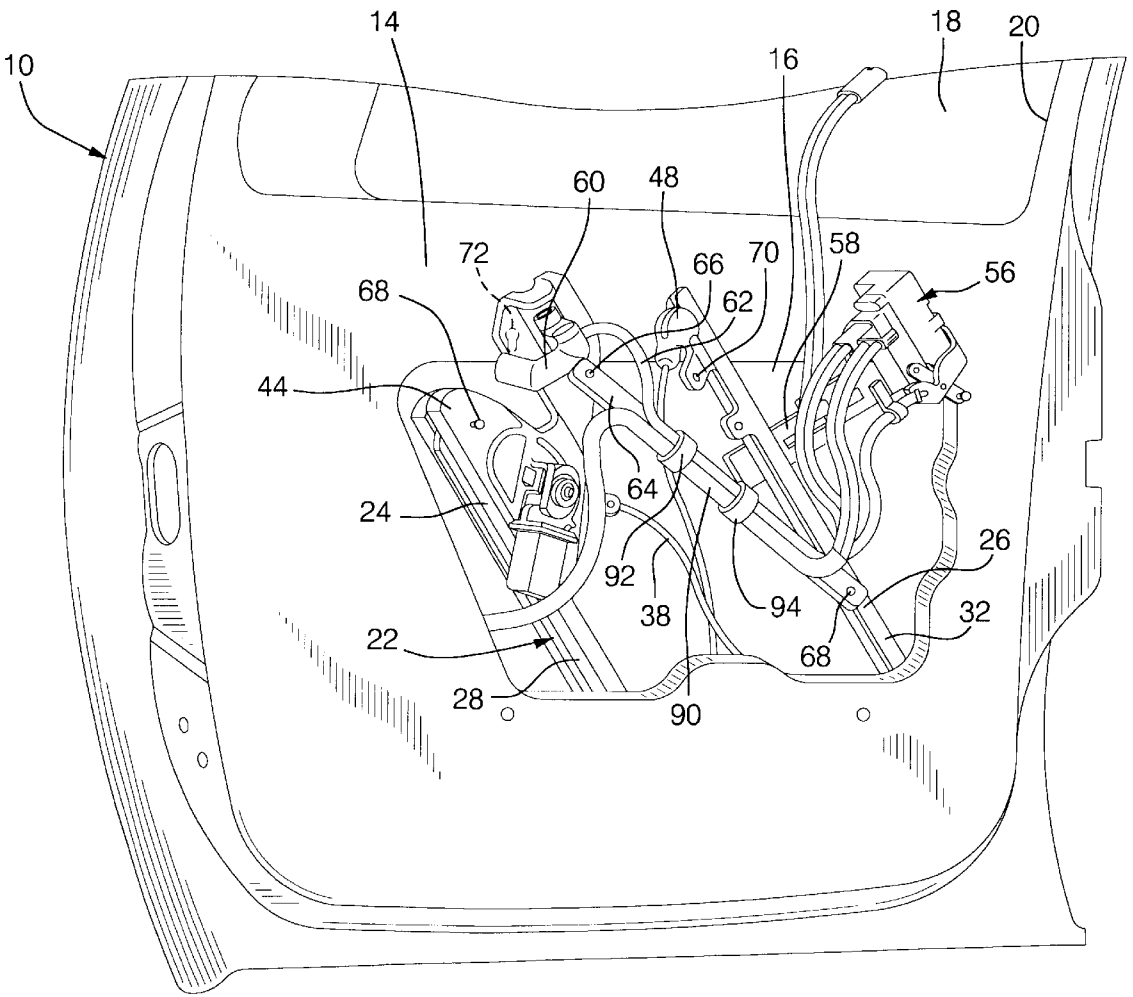
FIG. 2 shows the window lift module having been folded to enable insertion through the relatively small opening in the door inner panel.

Referring now to FIG. 2, it will be seen and appreciated that the window lift module 22 may be folded for compact installation into the cavity 16 of the vehicle door by moving the front lift rail 24 and rear lift rail 26 relatively closer together as enabled by the pivotal connection of the structural link 64 to the lift rails. Accordingly, the window lift module 22 can be inserted through an opening in the inner panel which is relatively smaller than would otherwise be required if the window lift module were unable to assume the folded condition of FIG. 2.

Figure 3:
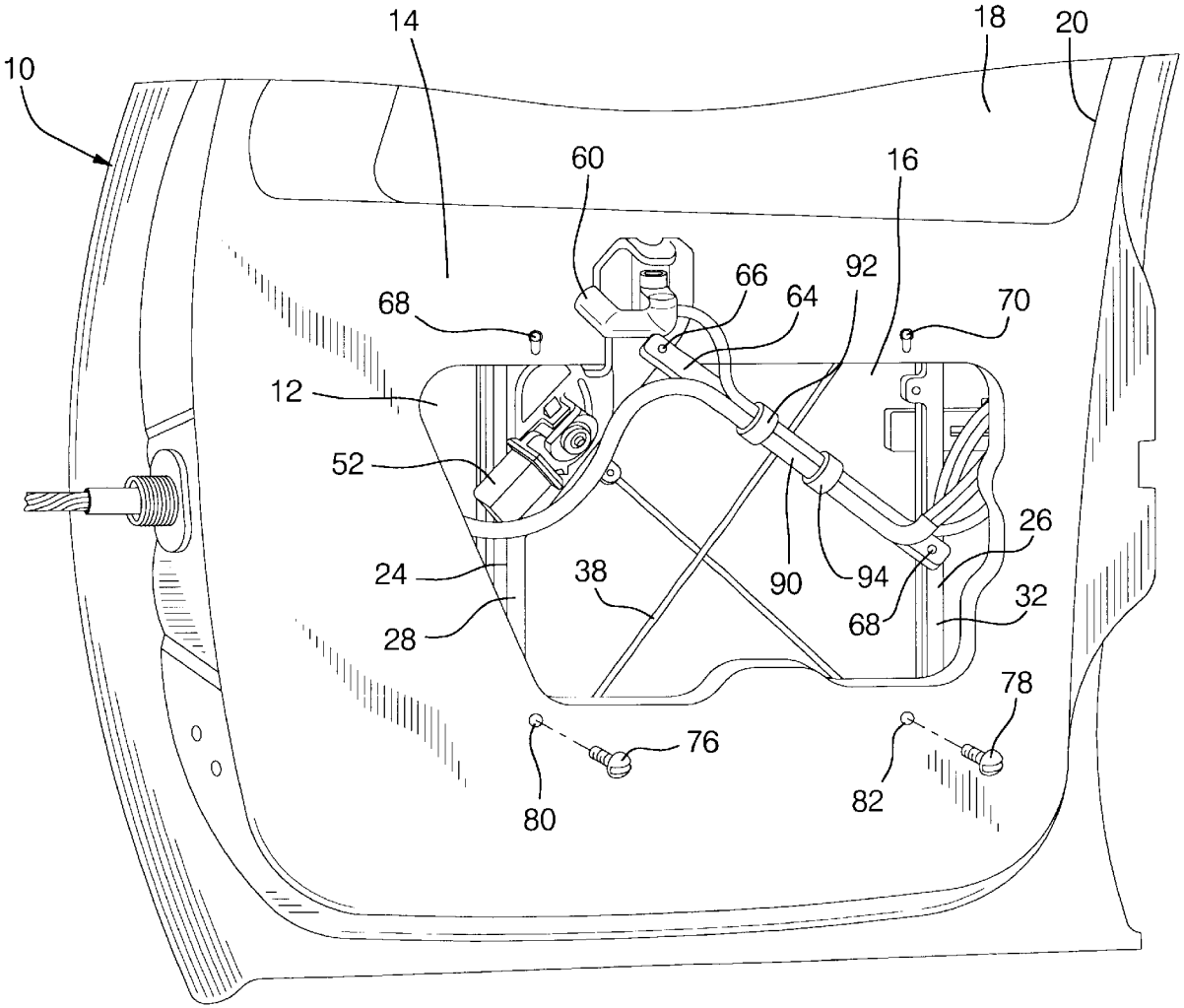
FIG. 3 shows the window lift module unfolded to its normal operating position and installed to the door inner panel.

FIG. 3 shows the window lift module 22 having been unfolded again to its normal operating position in which the lift rails 24 and 26 are again spaced apart in a parallel relationship with respect to each other. The window lift module 22 may be conveniently attached to the door inner panel by a pair of headed studs 68 and 70 which project from the upper ends of the front and rear lift rails 24 and 26 and can be inserted into key hole-shaped apertures 72 and 74 provided in the door inner panel 14. Screws 76 and 78 are then installed through apertures 80 and 82 provided in the door inner panel 14 and into apertured ears 84 and 86 provided respectively on the lower ends of lift rails 24 and 26.

Thus, it is seen that the invention provides a new and improved window lift module which may be folded to enable installation into a relatively small opening in the vehicle door inner panel. As seen in the drawings, the actuating cable 62 for the door latch, as well as wiring harness 90, may be conveniently anchored to the structural rail 64 by attaching clips 92 and 94.

While this invention has been described in terms of some specific embodiments, it will be appreciated that other forms can readily be adapted by one skilled in the art. Accordingly, the scope of this invention is to be considered limited only by the following claims.

I claim:

1. In a vehicle door having inner and outer panels defining a cavity therebetween and the inner panel having an opening to permit insertion of a door hardware module through the opening and into the cavity for attachment to the inner panel, the improvement comprising:

front and rear window lift rails extending parallel to one another and each having an upper end portion, a lower end portion and a guide block slidably mounted thereon for attachment to a window panel;

a drive cable attached to the guide blocks and routed through and between the lift rails so that motion of the drive cable in one direction lowers the guide blocks and motion of the drive cable in another direction raises the guide blocks;

a drive mechanism mounted on one of the lift rails to move the drive cable and a structural link extending diagonally between the parallel extending front and rear lift rails and having a first end pivotally connected to the front lift rail between the upper and lower end portions of the front lift rail and a second end pivotally connected to the rear lift rail between the upper and lower end portions of the rear lift rail so that the lift rails are connected together with the structural link to form the module, wherein the lift rails are pivotable relative to the structural link between an installation position wherein the lift rails extend parallel with respect to one another to enable insertion of the module through the opening in the inner panel and an operating position wherein the lift rails extend parallel with respect to one another for attachment to the inner panel.

2. The vehicle door of claim 1 further comprising a door latch mounted on the rear lift rail and a door handle mounted on the front lift rail, and an actuating cable operatively connecting the door latch and the door handle and being routed along and attached to the structural link.

* * * * *